US006502807B1

(12) United States Patent
Assaf et al.

(10) Patent No.: US 6,502,807 B1
(45) Date of Patent: Jan. 7, 2003

(54) EVAPORATIVE MEDIA UNIT FOR COOLING TOWER

(75) Inventors: Gad Assaf, Beer Sheva (IL); Moshe D Maroko, Hod HaSharon (IL)

(73) Assignee: AGAM Energy Systems Ltd., Hod HaSharon (IL)

( * ) Notice: Subject to any disclaimer, the term of this patent is extended or adjusted under 35 U.S.C. 154(b) by 0 days.

(21) Appl. No.: 09/763,474

(22) PCT Filed: Aug. 23, 1999

(86) PCT No.: PCT/IL99/00460

§ 371 (c)(1),
(2), (4) Date: Apr. 25, 2001

(87) PCT Pub. No.: WO00/11426

PCT Pub. Date: Mar. 2, 2000

(30) Foreign Application Priority Data

Aug. 25, 1998 (IL) ..... 125927

(51) Int. Cl.[7] ..... B01F 3/04

(52) U.S. Cl. ..... 261/112.2; 261/DIG. 72

(58) Field of Search ..... 261/94, 112.1, 261/112.2, DIG. 72, DIG. 11

(56) References Cited

U.S. PATENT DOCUMENTS

| | | | | | |
|---|---|---|---|---|---|
| 3,450,393 | A | * | 6/1969 | Munters | 261/112.2 |
| 3,792,841 | A | * | 2/1974 | Munters | 261/112.2 |
| 3,963,810 | A | * | 6/1976 | Holmberg et al. | 261/112.2 |
| 4,405,533 | A | * | 9/1983 | Norback et al. | 261/112.2 |

FOREIGN PATENT DOCUMENTS

| | | | |
|---|---|---|---|
| DE | 1100053 | * | 2/1961 |

* cited by examiner

*Primary Examiner*—C. Scott Bushey
(74) *Attorney, Agent, or Firm*—Bachman & LaPointe, P.C.

(57) ABSTRACT

The invention provides an evaporative media unit for use in cooling towers, the unit providing surfaces for heat exchange between liquid and air, and including at least one cross-fluted structure composed of multi-layered, corrugated cardboard sheets forming an array of inlet openings on a first side of the structure, and an array of outlet openings on a second side of the structure substantially opposite the first side.

8 Claims, 2 Drawing Sheets

EVAPORATIVE MEDIA UNIT FOR COOLING TOWER

FIELD OF THE INVENTION

The present invention relates to an unit constituting evaporative media and to a cooling tower utilizing same.

BACKGROUND OF THE INVENTION

In a cooling tower, the liquid is distributed on top of a filler material and flows downward, and air is blown across the filler material in counter-flow to the liquid. The resistance to heat and vapor transfer from the wet filler material to the air is dominated by the air boundary layer at the interface of the liquid. It can be shown that skin friction between the air and the liquid is also located at the same boundary layer. Therefore, there is a simple relationship between heat transfer (Q) and skin friction dissipation (SF), which is defined as a Reynolds analogy:

$$Q/SF=Cpdt/U^2$$

wherein:

Q is the heat flux per unit area of a duct;

dt is the log mean thermal gradient between air and the liquid;

Cp is the heat capacity of the air, and

U is the air velocity.

The above equation can be considered as the theoretical limit on the efficiency of heat transfer. Cpdt can be converted into an enthalpy gradient between the air and the liquid interface. In a conventional cooling tower, when the enthalpy gradient is about 25 kJ/kg and the air velocity is about 2 m/s, the Reynolds analogy will predict Q/SF=20000/4=5000. Actually, in a conventional cooling tower, the ratio of heat transfer to the blower's work Wb, is considerably smaller, of the order of 200 only. Apparently, only a small fraction of the blown air dissipates as skin friction on wet surfaces.

There are four main reasons for the difference:

a) The air blower's efficiency is about 50%.

b) In most cases, air exits from the cooling tower at speeds of about 8 m/s, which rejects kinetic energy.

c) The Reynolds analogy relates heat transfer to skin friction at the boundary layer. Thus, the skin friction enhances the heat transfer. In a conventional cooling tower, energy dissipated by wakes and eddies developed in and behind the filler material plays a dominant role. Unlike SF, wake and large eddy dissipation does not enhance the heat transfer from the liquid to the air, and therefore this energy is totally lost.

d) The filler material in cooling towers is usually made of plastic, which does not absorb liquid; it therefore becomes partly dry when the liquid film on the plastic plates does not cover their entire surfaces.

Commonly used filler materials in variable enthalpy (VE) devices are wooden slats and layers of impregnated plastic boards. The distance between the slats is a few centimeters, and the Reynolds number (Re) of the air, related to this distance, is expressed by:

$$Re=UD/Ni=3000$$

wherein:

U is the air velocity inside the filler material;

D is the hydraulic diameter of the grooves between the layers of filler material; and Ni is the kinematic viscosity of the air.

Thus, $$D=4A/C,$$

wherein

A is the area across the flow, and

C is the perimeter of the grooves.

At Re=3000, the wake generated is effective in dissipating the blown air and reduces the efficiency of the cooling tower. In addition, the wet surface area of the plates is usually less than 100 square meters per cubic meter of filler.

In general, an invariant enthalpy (IE) device is characterized by a small thermal gradient between the liquid and the air. Evaporative cooling air enters at, e.g., 30° C. and exits at 22° C., while the liquid temperature is 20° C. The log mean temperature gradient is therefore only 5° C., which is equivalent to an enthalpy gradient of 5 kJ between the liquid interface and the air. This gradient is one-fifth of the enthalpy gradient found in a cooling tower. As the liquid temperature is practically constant, IE heat exchangers are usually based on cross-flow arrangements, namely, the liquid flows down while the air is directed to flow horizontally. In a IE heat exchanger, the cross-flow is thermodynamically inferior as compared with counter-flow arrangements, wherein air flows upwards and liquid downwards.

Heat exchangers for IE commonly use cooling pads made of cellulose, which absorb liquid and become wet even when the liquid does not cover the entire area. The cross-flow reduces the water flow rate for evaporative cooling, and thus a substantial amount of liquid is required to thoroughly wet the cooling pad.

In a typical invariant enthalpy (IE) arrangement, a cooling pad is 10 cm wide, 1.5 m long, and 25 m wide, and stands upright as a wall in a greenhouse to be cooled, large blowers force air at a normal speed of 2 m/sec. It can be shown that the cooling capacity of such an arrangement is about 450 kW. The evaporation rate of this system is 0.18 liter/sec. To wet the cooling pads, water distribution on top of the cooling pads should be about 2.5 liters/sec, for a cooling capacity of 450 kW.

In a variable enthalpy (VE) cooling tower, however, a capacity of 450 kW requires a liquid flow rate of 25 liters/sec, which is 10 times more than that required in an IE cooling tower. At this flow rate, the cooling pads will be filled with liquid and the resistance to air flow will be too large. Therefore, in order to obtain the same cooling capacity, the cooling tower should contain about 5 times the area of the cooling pads, since water distribution should be 5 times larger than the area of the water distribution in an IE cooling pad device.

U.S. Pat. No. 3,450,393 (Munters) describes a gas and liquid contact packing for cooling towers in which the spraying device arranged above the packing effects even diffusion of the liquid on the packing. Various modifications of packings are illustrated, so as to assure that the openings in the packings will not become clogged by deposits and scale formation and to prevent flooding of liquid or bridging of liquid droplets within the packings.

It is therefore a broad object of the present invention to provide an evaporative media which will minimize wake dissipation and maximize wet surface area in VE devices.

It is a further object of the present invention to provide improved cooling towers utilizing evaporative media which minimize wake dissipation and maximize wet surface area.

SUMMARY OF THE INVENTION

In accordance with the present invention, there is therefore provided a cooling tower, comprising a housing, pressurized liquid distribution means located at the upper portion of said housing; a liquid collection vessel located at the lower portion of said housing; at least one evaporative media located inside said housing between said liquid distribution means and said collection vessel; said evaporative media being constituted by multi-layered, corrugated cardboard sheets arranged to form a cross-fluted structure having wettable surfaces, an array of inlet openings on a first side of said structure, and an array of outlet openings on a second side of said structure substantially opposite said first side; at least one blower located within said housing for producing air flow within the cross-fluted structure of said evaporative media; characterized in that the hydraulic diameter of the flutes of said structure is less than 1.5 cm; the wettable surface area of said structure is more than 250 $m^2$ for every cubic meter thereof, and said blower produces an air flow within said cross-fluted structure of the evaporative media having a Reynolds number of less than 2,000.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF PREFERRED EMBODIMENTS

Figure 1:
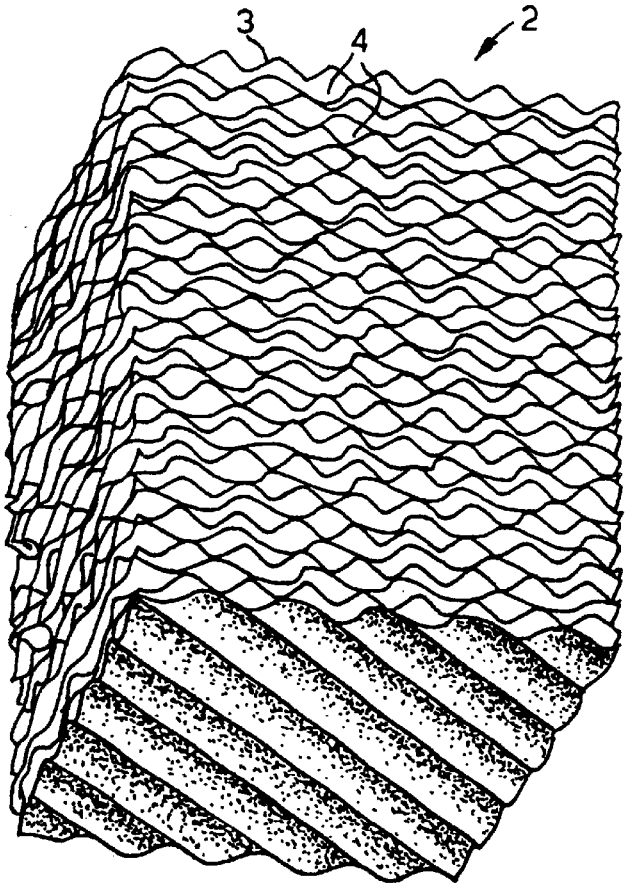
FIG. 1 is an enlarged, perspective view of an evaporative media unit according to the present invention.

There is shown in FIG. 1 a perspective view of an evaporative media unit 2, constituted of multi-layered, corrugated cardboard sheets 3 arranged to form a cross-fluted structure. The structure includes an array of inlet openings 4 on its top surface and an array of outlet openings (not shown) on its bottom surface, which openings are interconnected by the flutes.

In accordance with a preferred embodiment of the present invention, the hydraulic diameter D of evaporative media 2 is less than 1 cm. Thus, $$D=4A/C$$

wherein

A is the average cross-sectional area of the flutes, and

C is the peripheral length of flute openings.

Preferably, the wet area of the media is larger than 250 $m^2$, per cubic meter of media. Furthermore, the Reynolds number (Re) of the air flow inside the evaporative media advantageously is:

$$Re=UD/Ni<2000$$

U is the velocity of the air, and

Ni is the viscosity of the liquid.

Such a Re reduces the development of wakes.

The air energy dissipation in the dense packing of the media is dominated by skin friction, which enhances heat transfer between the air and the wet surfaces of the media As a result, some 50% of the energy dissipation becomes skin friction which enhances the heat transfer and at the same time reduces the undesired energy dissipation of wakes and large eddies.

Another important advantage of the dense packaging for VE liquid air and vapor heat exchangers is that it considerably reduces the media's height, thus saving pumping energy of the liquid in a cooling tower.

Figure 2:
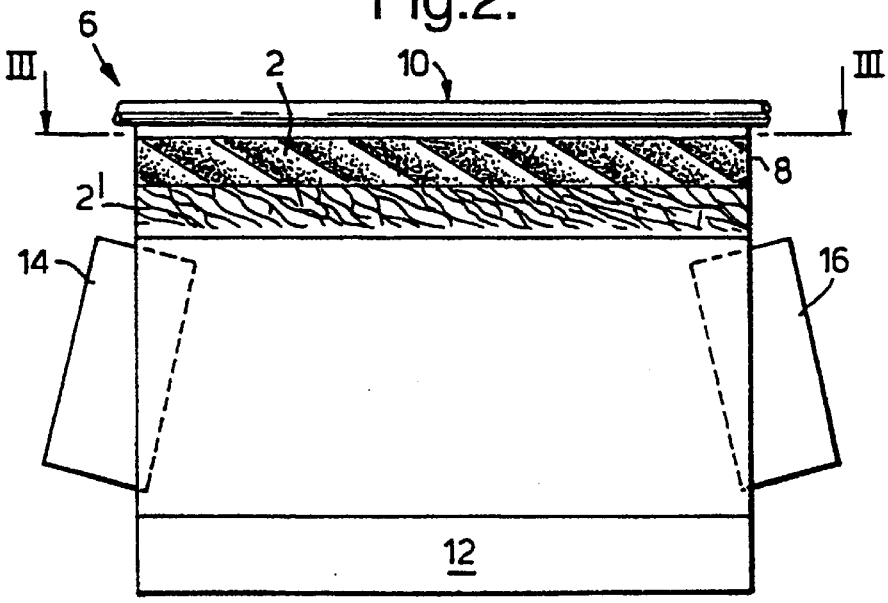
FIG. 2 is a side view of a cooling tower according to the present invention, incorporating the evaporative media unit of FIG. 1.
Figure 3:
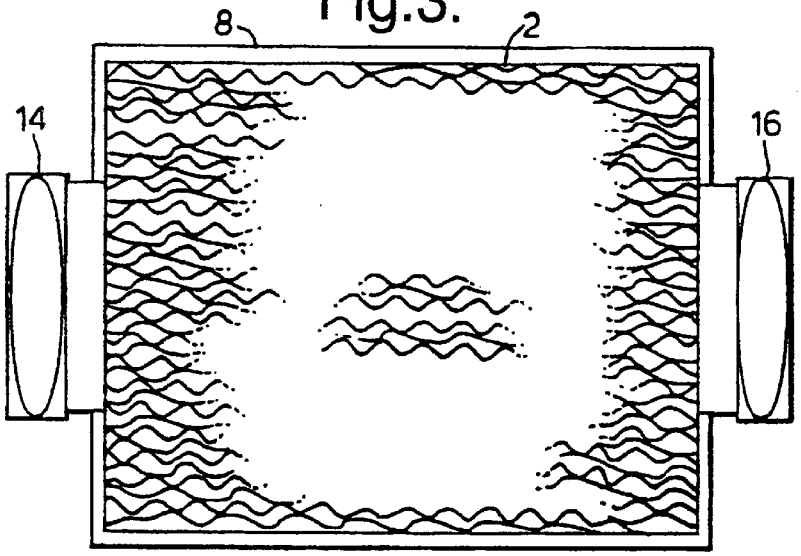
FIG. 3 is a top view along lines III—III of FIG. 2.

There is seen in FIGS. 2 and 3 a cooling tower 6, comprising a housing 8; pressurized liquid distribution means 10, which will be described in greater detail below with respect to FIGS. 4 to 6; liquid collection vessel 12 located at the lower portion of the housing, and blower (not shown) inlet ports 14, 16. Below the liquid distribution means 10 is disposed the evaporative media 2, with its array of inlet openings 4 facing upwards towards the liquid distribution means 10. Advantageously, there is provided at least one further similar evaporative media 2' below the first media, however, this second media is substantially perpendicularly disposed with respect to the first media. Further evaporative media, perpendicularly oriented with respect to each other, can also be added.

Figure 4:
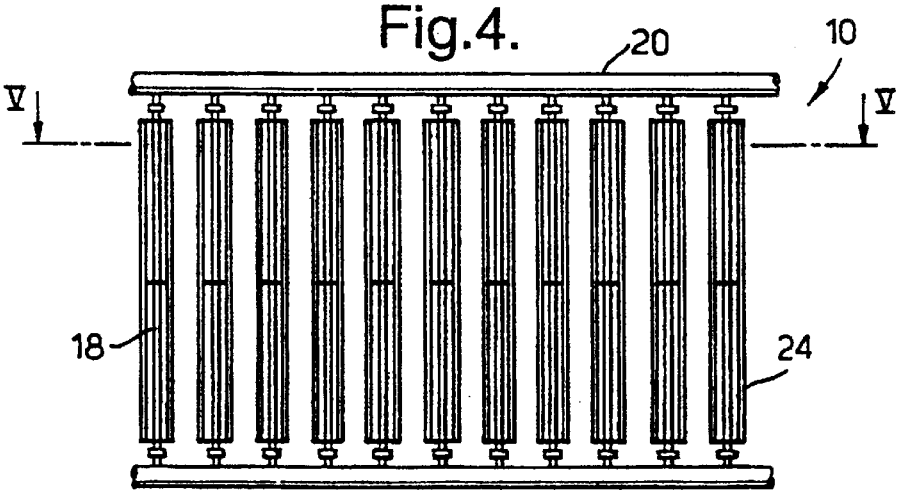
FIG. 4 is a top view of the liquid distribution means of the cooling tower according to the present invention.
Figure 5:
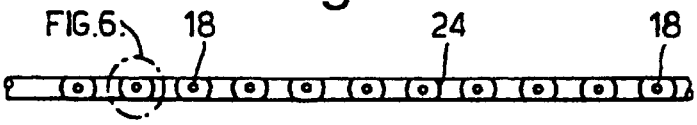
FIG. 5 is a cross-sectional view along lines V—V of FIG. 4.
Figure 6:
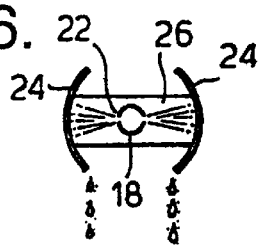
FIG. 6 is an enlarged, cross-sectional view of a single spray pipe and spray impacting and sprinkling means shown in FIG. 5.

Referring now to FIGS. 4 to 6, there is illustrated a preferred embodiment of a liquid distribution means 10, consisting of a bank of spray pipes 18, disposed substantially in parallel and connectable, by means of a manifold 20, to a source of liquid. The spray pipes 18 extend across the individual corrugated cardboard sheets 3 of which the cross-fluted structure is composed. Spray pipes 18 have spaced-apart openings 22 extending along their axis. The diameter of openings 22, their spacing and their angular disposition around the pipes, as well as the size, shape and disposition of the spray impacting and sprinkling means 24 affixed adjacent to openings 22, are precalculated in accordance with various considerations, including the type of liquid used (its viscosity), the desired flow rate, etc. Sprinkling means 24 are configured to collect the liquid spray 26 exiting from openings 22 and to trickle drops of liquid into the array of inlet openings 4 of the evaporation media 2 located just below, practically forming a plurality of screens of drops and thereby assuring satisfactory distribution of liquid throughout the entire surface of the media. The trickling of drops of liquid into inlet openings 4, to be absorbed by the walls of the flutes, effects the wetting of the entire media, either directly or by capillary action, thereby maximizing the wet surface area of the media.

While in FIGS. 4 to 6 the impacting and sprinkling means 24 are configured as elongated, arc-shaped surfaces, it should be understood that many other configurations, such as planar surfaces, V-shaped surfaces, or the like, are also envisioned.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A cooling tower, comprising:

a housing;

pressurized liquid distribution means located at the upper portion of said housing;

a liquid collection vessel located at the lower portion of said housing;

at least one evaporative media located inside said housing between said liquid distribution means and said collection vessel;

said evaporative media being constituted by multi-layered, corrugated cardboard sheets arranged to form a cross-fluted structure having wettable surfaces, an array of inlet openings on a first side of said structure, and an array of outlet openings on a second side of said structure substantially opposite said first side;

at least one blower located within said housing for producing air flow within the cross-fluted structure of said evaporative media;

characterized in that the hydraulic diameter of the flutes of said structure is less than 1.5 cm;

the wettable surface area of said structure is more than 250 $m^2$ for every cubic meter thereof, and said blower produces an air flow within said cross-fluted structure of the evaporative media having a Reynolds number of less than 2,000.

2. The cooling tower as claimed in claim 1, wherein said liquid distribution means comprises a bank of spray pipes disposed substantially in parallel and connectable to a source of liquid.

3. The cooling tower as claimed in claim 2, wherein said spray pipes further comprise spaced-apart openings extending along their axes.

4. The cooling tower as claimed in claim 3, wherein said openings are made along the lateral wall portions of said pipes.

5. The cooling tower as claimed in claim 4, further comprising liquid spray impacting and sprinkling means disposed in spaced-apart relationship along said lateral wall portions of said pipes.

6. The cooling tower as claimed in claim 5, wherein said spray impacting and sprinkling means are shaped surfaces configured to collect said liquid spray and to tickle drops of liquid into said array of inlet openings.

7. The cooling tower as claimed in claim 6, wherein said spray impacting and sprinkling means are elongated, arc-shaped surfaces, the concave surfaces thereof being positioned so as to face said pipes.

8. The cooling tower as claimed in claim 1, wherein there are provided two superposed cross-fluted structures arranged in the cooling tower so that the respective corrugated cardboard sheets of one structure substantially traverse the sheets of the other structure.

* * * * *